US008714555B1

(12) United States Patent
Kelsey et al.

(10) Patent No.: US 8,714,555 B1
(45) Date of Patent: May 6, 2014

(54) CONTAINER-POPPING GAME

(71) Applicants: Jeremy Kelsey, Auckland (NZ); Christopher John McGrath, Wights Mountain (AU)

(72) Inventors: Jeremy Kelsey, Auckland (NZ); Christopher John McGrath, Wights Mountain (AU)

(73) Assignee: LAI Games International Pte Ltd., Singapore (SG)

( * ) Notice: Subject to any disclaimer, the term of this patent is extended or adjusted under 35 U.S.C. 154(b) by 0 days.

(21) Appl. No.: 13/667,283

(22) Filed: Nov. 2, 2012

(51) Int. Cl.
*A63F 9/00* (2006.01)

(52) U.S. Cl.
USPC ..... 273/457; 273/445; 273/458; 273/459

(58) Field of Classification Search
USPC ..... 273/440, 445, 447, 458, 459
See application file for complete search history.

(56) References Cited

U.S. PATENT DOCUMENTS

| | | | | |
|---|---|---|---|---|
| 3,861,684 | A * | 1/1975 | Gastin et al. | 273/287 |
| 6,264,201 | B1 * | 7/2001 | Holsten et al. | 273/384 |
| 7,134,665 | B2 * | 11/2006 | Holsten et al. | 273/458 |
| 7,487,972 | B2 * | 2/2009 | Halliburton | 273/458 |
| 8,016,292 | B1 * | 9/2011 | Yang et al. | 273/451 |
| 8,079,597 | B1 * | 12/2011 | Wei | 273/451 |
| 2006/0232014 | A1 * | 10/2006 | Holsten et al. | 273/458 |

* cited by examiner

*Primary Examiner* — Raleigh W Chiu
(74) *Attorney, Agent, or Firm* — Fulbright & Jaworski LLP

(57) ABSTRACT

A pressure-filled container-popping game is defined with pressure-filled containers that are positioned in a game play area behind various barriers. Each pressure-filled container has one or more prizes coupled to it. The barriers have openings or orifices which provides access to a corresponding pressure-filled container through the barrier. A player positions a moveable target arm using a game control attempting to align a piercing member attached to the target arm with a selected one of the orifices. When the player believes the piercing member is properly aligned, an attempt is triggered which causes the target arm to move the piercing member toward the selected orifice. If it is properly aligned, the piercing member passes through the orifice and impacts the corresponding pressure-filled container, popping it and sending the coupled prize or prizes falling into a prize chute. Otherwise, the piercing member impacts the barrier, ending the players game attempt.

20 Claims, 10 Drawing Sheets

CONTAINER-POPPING GAME

CROSS-REFERENCE TO RELATED APPLICATIONS

This application claims the benefit of U.S. Provisional Patent Application No. 61/555,379, entitled "CONTAINER-POPPING GAME," filed Nov. 3, 2011, the disclosure of which is hereby incorporated herein by reference.

TECHNICAL FIELD

The present disclosure relates, in general, to amusement gaming, and, more particularly, to container-popping games.

BACKGROUND

Prize-dispensing arcade games, also known in the art as redemption arcade games, are popular entertainment machines that are commonly found in arcades, malls, theaters, restaurants, theme parks, and other locations with large concentrations of people. These machines typically display objects, such as stuffed animals, trinkets, electronic devices, and other desirable prizes, hanging from or affixed to mechanical arms or connectors inside a game cabinet and are clearly visible to those who pass by. Usually, these objects are offered as prizes to a player who wins or accomplishes some predetermined objective of the game. Typically, a player will insert a game credit, which may be some form of monetary credit, token, or the like to play the game. The player then plays the game and attempts to accomplish the predetermined objective in order to win the game. If the player is successful, a prize is typically immediately awarded to the player through a door or compartment in the game cabinet. When the objective is achieved, the game mechanism operates to release one of the prizes from the mechanical arm or connector to a chute or pathway that leads to this compartment in the game cabinet.

BRIEF SUMMARY

Representative embodiments of the present disclosure are directed to redemption arcade games that provide a container-popping game functionality. One or more pressure-filled containers are positioned in the game play area behind various barriers. A prize or prizes are coupled to each such container. There is also an opening or orifice in the barriers in which the orifice provides access to a corresponding container through the barrier. A player positions a moveable target arm using a game control attempting to align a piercing member attached to the target arm with a selected one of the orifices. When the player believes the piercing member is properly aligned, he or she triggers an attempt which could be triggered by pushing a button or triggered automatically when the movement of the movable arm is stopped. This trigger causes the target arm to move the piercing member toward the selected orifice. If it is properly aligned, the piercing member passes through the orifice and impacts the corresponding pressure-filled container, popping it and sending the coupled prize or prizes falling into a prize chute. If the piercing member is not properly aligned, it will impact the barrier and end the players attempt.

The foregoing has outlined rather broadly the features and technical advantages of the present disclosure in order that the detailed description that follows may be better understood. Additional features and advantages will be described hereinafter which form the subject of the claims of this disclosure.

It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the present disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawing, in which.

DETAILED DESCRIPTION

In the detailed description below, numerous specific details are set forth to provide a thorough understanding of claimed subject matter. However, it will be understood by those skilled in the art that claimed subject matter may be practiced through other means similar to these specific details. In other instances, methods, apparatuses or systems that would be known by one of ordinary skill have not been described in detail so as not to obscure claimed subject matter. Some portions of the detailed description may be presented in terms of algorithms or symbolic representations of operations on data bits or binary digital signals stored within a computing system memory, such as a computer memory. These algorithmic descriptions or representations are examples of techniques used by those of ordinary skill in the art to convey the substance of their work to others skilled in the art.

An algorithm is here, and generally, considered to be a self-consistent sequence of operations or similar processing leading to a desired result. In this context, operations or processing involve physical manipulation of physical quantities. Typically, although not necessarily, such physical quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like, refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

Figure 1:
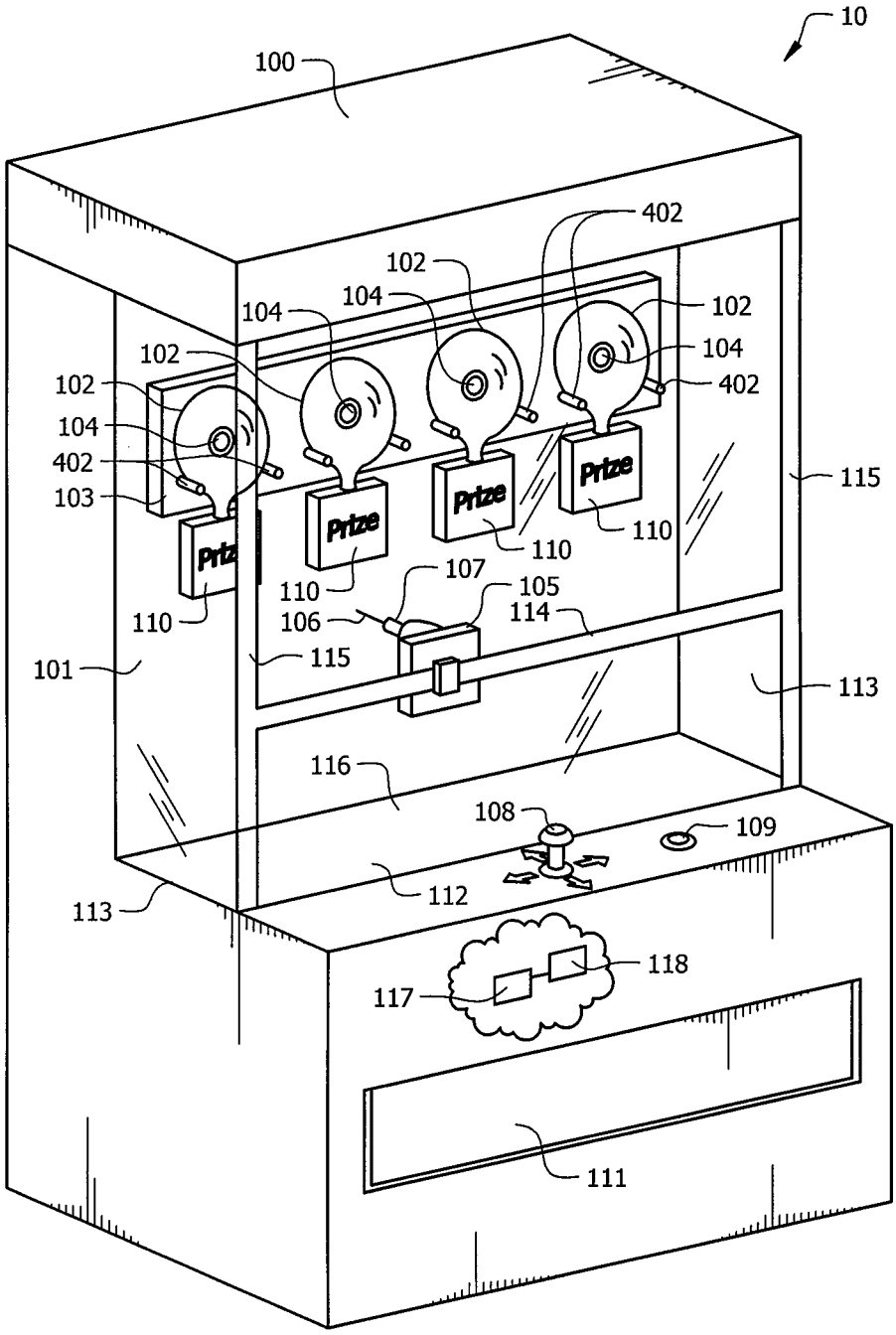
FIG. 1 is a diagram illustrating a container-popping game configured according to one embodiment of the present disclosure.

FIG. 1 is a diagram illustrating pressure-filled container-popping game 10 configured according to one embodiment of the present disclosure. Pressure-filled container-popping game 10 includes game cabinet 100 with front panel 112 and side panels 113 defining game play/prize area 101. Within game play/prize area 101, a number of balloons 102 are suspended between container brackets 402. Each of balloons 102 has a prize 110 coupled thereto. Prizes 110 are physically coupled to balloons 102 and, thus, are suspended within game play/prize area 101 from balloons 102. Barrier 103 is placed in front of balloons 102, such that barrier 103 is positioned between a player standing in front of pressure-filled container-popping game 10 and balloons 102. Barrier 103 has multiple orifices 104 positioned such that each of balloons 102 lies directly behind the opening of orifices 104 behind barrier 103.

It should be noted that the various embodiments of the present disclosure may use various different types of pressure-filled containers. The examples given in many of the representative figures use balloons, such as balloons 102. However, it should be apparent that any other type of perforatable container filled with air or any other gas may be used to implement the various embodiments of the present disclosure. The container may also comprise self-healing material, such that it may be re-filled repeatedly after successful "popping" of the container to release a prize during game play.

It should further be noted that prizes may be coupled to the pressure-filled containers in any manner of different ways. As illustrated in FIG. 1, prizes may be directly coupled to the pressure-filled container. In alternative embodiments of the present disclosure, prizes may be indirectly coupled or electronically coupled to the pressure-filled containers, such that there is no direct physical contact between the prize and the pressure-filled container, but there is an indirect coupling, whether through physical indirect coupling or electronic indirect coupling.

It should further be noted that barrier 103 may comprise any number of different materials and levels of opacity or translucency and have any number of orifices in it for the piercing needle 106 to pop the container. In one embodiment, barrier 103 may be a piece of clear Plexiglas with one orifice per container. In other embodiments barrier 103 may be a completely opaque material with multiple orifices 104 for each container with graphics drawn thereon or translucent with the characteristics of having some balloons 102 visible behind it. The various embodiments of the present disclosure are not limited to a specific material or composition for barrier 103 or a specific number of orifices 104 for each balloon or container.

Pressure-filled container-popping game 10 also includes target arm 105, which is movable along an X-Y plane. Target arm 105 is coupled to horizontal track 114 and, through a drive mechanism (not shown), traverses in both directions of an X-axis. Track 114 is coupled, at both ends, to vertical tracks 115. Target arm 105 is moved in both directions of a Y-axis through another one or more drive mechanisms that move horizontal track 114 in the Y-axis directions along vertical tracks 115. A player controls the motion of target arm 105 along the X-Y plane by manipulating joystick 108. In response to the player's input to joystick 108, target arm is moved along the X-Y axis through activation of the corresponding drive mechanisms.

It should be noted that the drive mechanism illustrated in FIG. 1 is only one of many different types of drive mechanisms that may be used to implement the various embodiments of the present disclosure or various methods for moving target arm 105. While additional examples are provided through the disclosure, these means are merely a few non-limiting examples of how the movement of target arm 105 may be implemented.

To play pressure-filled container-popping game 10, a player manipulates joystick 108 to move target arm 105 into a position directly opposite one of orifices 104. When the player believes target arm 105 to be properly positioned and aligned, he or she activates button 109 which causes telescoping mechanism 107 of target arm 105 to extend along a Z-axis, pushing needle 106 toward one of orifices 104. If lined up correctly, needle 106 travels through orifice 104 to impact and pop the corresponding one of balloons 102. Without balloon 102 secured between container brackets 402, when balloon 102 is popped, prize 110 falls into prize chute 116. The player may then retrieve prize 110 through prize access panel 111. If target arm 105 was not properly aligned with orifice 104, needle 106 will impact barrier 103, causing telescoping mechanism to retract to its original position. Needle 106 impacting barrier 103, instead of passing through orifice 104 will be deemed a failure of the game's objective.

It should be noted that the functionality of pressure-filled container-popping game 10 is controlled by processor 117, as shown in a cut-away view in FIG. 1. Processor 117 works in conjunction with memory 118, which stores the software or firmware code that defines the operational aspects of pressure-filled container-popping game 10, and is coupled to each of the operational components of pressure-filled container-popping game 10, including user input controls, such as joystick 108 and button 109.

Figure 2:
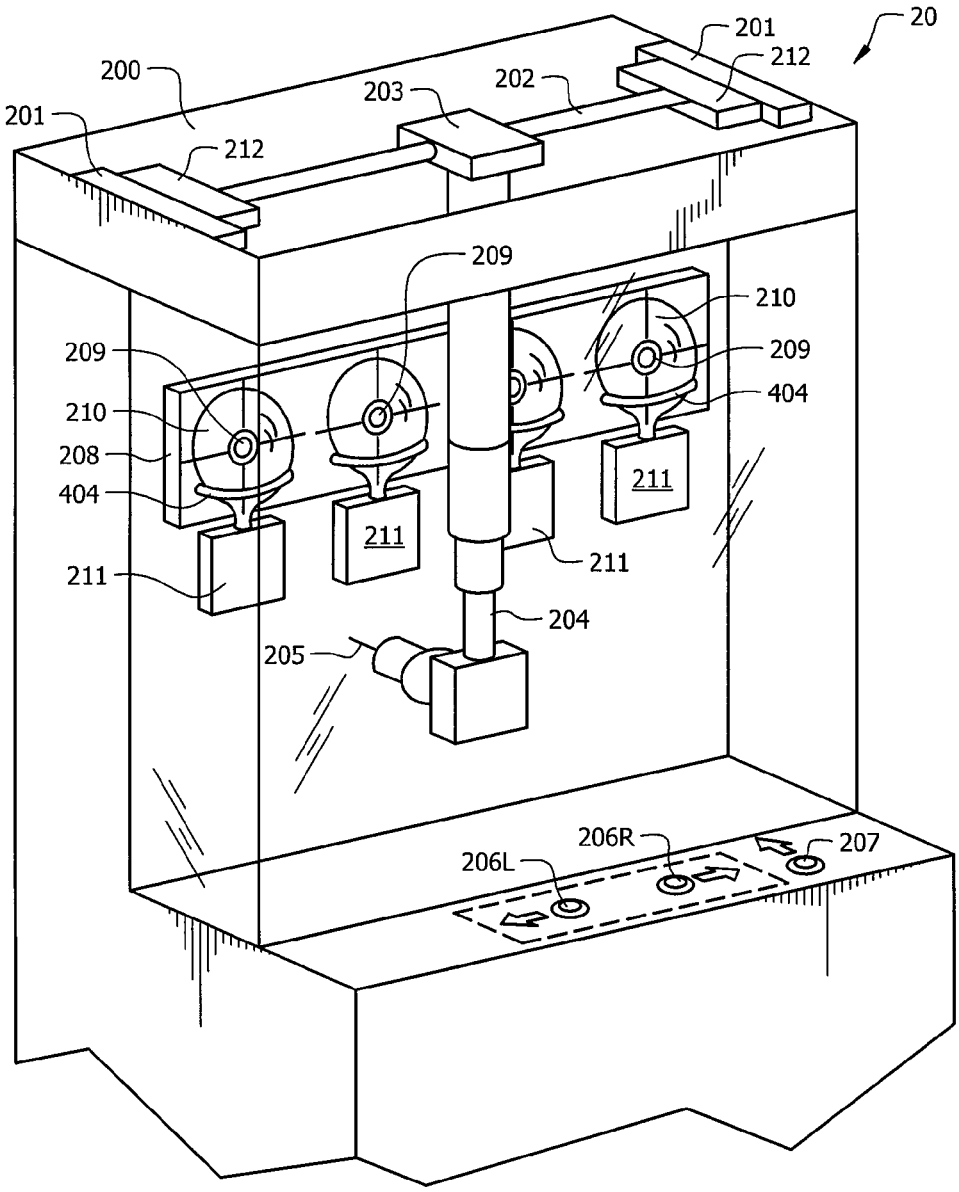
FIG. 2 is a diagram illustrating a redemption arcade game configured according to one embodiment of the present disclosure.

FIG. 2 is a diagram illustrating redemption arcade game 20 configured according to one embodiment of the present disclosure. Redemption arcade game 20 is also a pressure-filled container-popping game. Within game cabinet 200, target arm 204 is coupled to traverse rail 202. A driver motor 203 provides movement along traverse rail 202, which causes target arm 204 to move in left and right horizontal directions, as controlled by a user manipulating traverse buttons 206L and 206R, respectively. Traverse rail 202 is coupled to side rails 201 through driver motors 212, which allow movement of target arm 204 toward and away from the back of game cabinet 200. Redemption arcade game 20 includes a single row of balloons 210 suspending by container brackets 404 from game cabinet 200. Prizes 211 are coupled to balloons 210. Balloons 210 are positioned within game cabinet 200 behind target barrier 208. Target barrier 208 includes cross-hairs graphics 210 surrounding opening 209, which provides an open point completely through target barrier 208.

In operation of redemption arcade game 20, the user provides input to buttons 206L and 206R to position target arm 204 such that target needle 205 is aligned directly opposite of opening 209. When the user is satisfied that target needle 205 is correctly lined up, he or she activates button 207, which triggers driver motors 212 to begin moving traverse rail 202 toward the back of game cabinet 200 on side rails 201, thus, causing target arm 204 to advance toward target barrier 208. If the user correctly aligned target needle 205 with opening 209, target needle 205 will pass through opening 209, through target barrier 208, and impacting and popping the corresponding one of balloons 210. With balloon 210 popped, the remnants fall through container bracket 404 causing the corresponding one of prizes 211 to fall into the prize chute (not shown). If the user has not correctly aligned target needle 205 with opening 209, target needle 205 will impact target barrier 208, causing target arm 204 to retract to its original position. Redemption arcade game 20 will then indicate an objective failure to the user.

In another alternative embodiment supported by FIG. 2, buttons 206L and 206R are not present. When a user begins game play, target arm 204 begins automatically moving with driver motor 203 moving target arm 204 back-and-forth along traverse rail 202. When the user believes that target needle 205 is properly aligned with one of the openings 209, he or she activates button 207, which causes target arm to stop traversing traverse rail 202, but begins moving target needle toward target barrier 208. If target needle 205 is properly aligned with opening 209 it will pass through to pop the corresponding one of balloons 210. Otherwise, the user's turn will fail.

Figure 3:
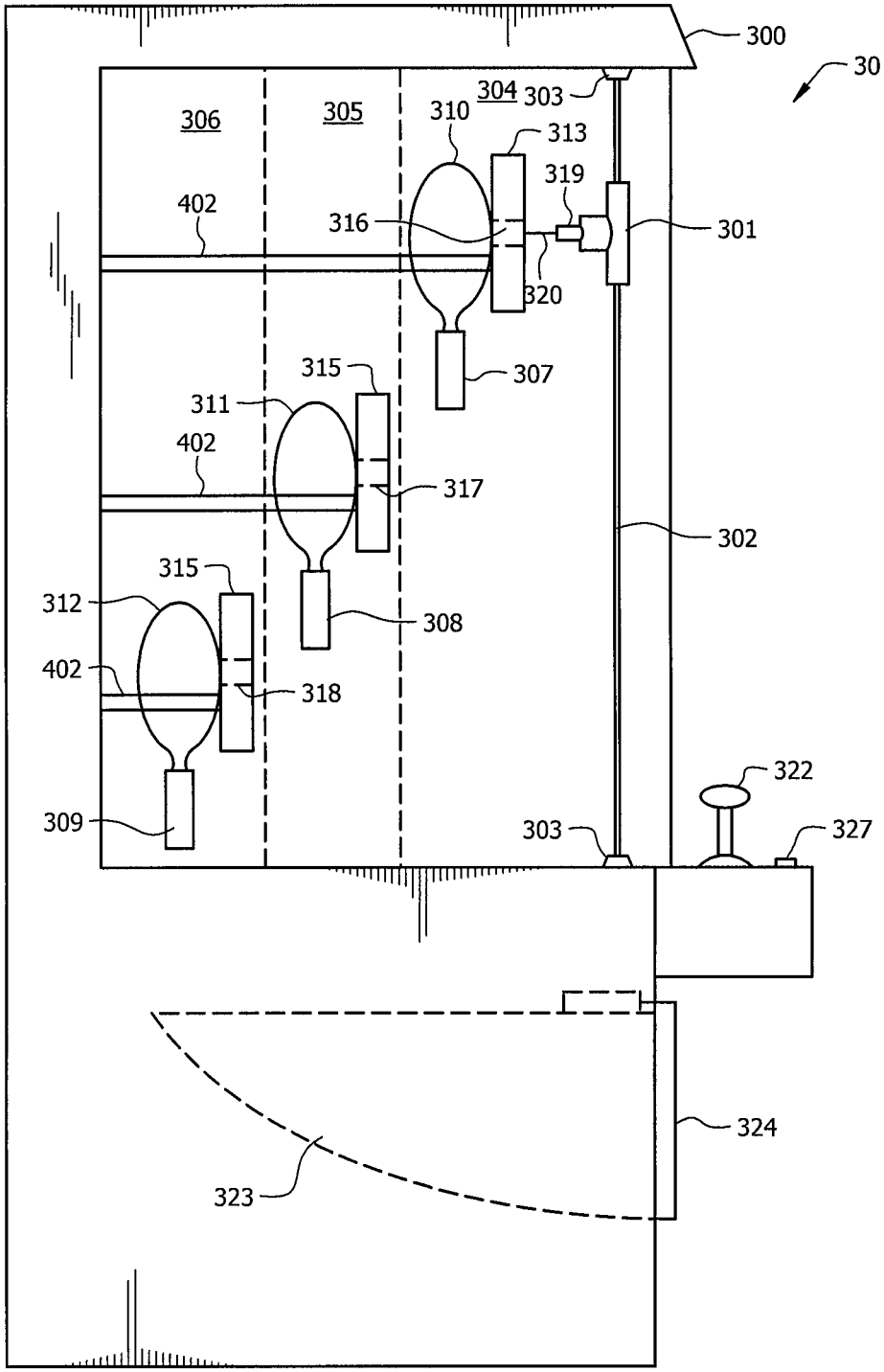
FIG. 3 is a diagram illustrating a side view of a redemption arcade game configured according to one aspect of the present disclosure.

FIG. 3 is a diagram illustrating a side view of redemption arcade game 30 configured according to one aspect of the present disclosure. Redemption arcade game 30 includes game cabinet 300 which displays a number of prizes 307-309 coupled to and hanging from balloons 310-312, which are suspended by container brackets 402 coupled to the back wall of game cabinet 300. Balloons 310-312 are layered within game cabinet 300 in layers 304-306 in order to provide a maximum number of pressure-filled containers and prizes available for game play. Balloons 310-312 are also just one of the pressure-filled containers in rows obscured by this side view of FIG. 3. Additional pressure-filled containers, next to balloons 310-312, extend in the rows of each of layers 304-306. Barriers 313-315 are located in front of the rows of balloons 310-312. Barriers 313-315 also include orifices 316-318, which provide an opening through barriers 313-315 to a corresponding pressure-filled container, such as balloons 310-312.

The game operates using target arm 301, which a player can move using input from joystick 321. Target arm 301 is coupled to vertical track 302. A drive mechanism (not shown) allows target arm 301 to move up and down vertical track 302 under control of the player's input through joystick 321. Vertical track 302 is coupled to horizontal tracks 303. Additional drive mechanisms (not shown) allow vertical track 302 to move from side to side of game cabinet 300 also under control of input delivered by the player using joystick 321. Thus, using joystick 321, the player can position target arm 301 in a desired position. Target arm 301 is coupled to needle 320 through telescoping component 319. The player attempts to line up needle 320 with one of the orifices in barriers 313-315, such as orifices 316-318, using joystick 321. When the player believes needle 320 to be correctly aligned, he or she activates button 322, which triggers telescoping component 319 to extend, thus, moving needle 320 toward the back of game cabinet 300. If the player has aligned target arm 301 correctly, telescoping component 319 will move needle 320 through the corresponding orifice, such as orifice 316, to impact and pop a corresponding pressure-filled container, such as balloon 310. The remnants of popped balloon 310 will fall between container brackets 402 allowing prize 307 to fall into prize chute 323, which the player can access through prize access panel 324. If the player did not correctly align target arm 301, needle 320 will impact one of barriers 313-315, such as barrier 313, and retract to its original position. Redemption arcade game 30 will then indicate to the player the unsuccessful attempt.

In addition to maximizing the number of pressure-filled containers and prizes available for game play, the layering of the rows of pressure-filled containers, including balloons 310-312, allows for varying the value of the prizes. As the distance between target arm 301 and barriers 313-315 increases, the difficulty for the player to successfully align target arm 301 with the corresponding orifice, such as orifices 316-318, also increases. Therefore, in additional embodiments of the present disclosure, the hosting entity may place more valuable prizes coupled to the pressure-filled containers in the row of layer 306, less valuable prizes coupled to the pressure-filled containers in the row of layer 305, and still less valuable prizes coupled to the pressure-filled containers in the row of the closest layer, layer 304.

Figure 4A:
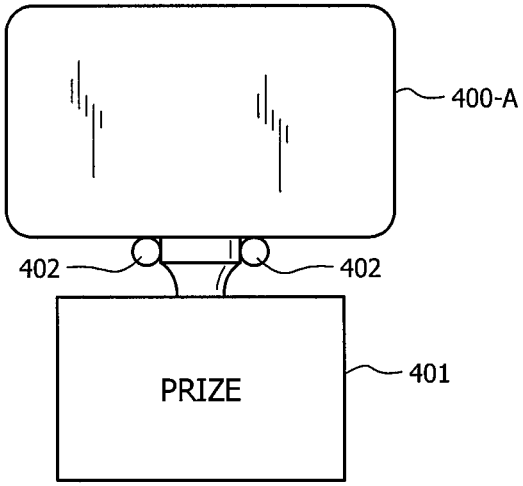
FIG. 4A is a front view illustrating a single container—prize combination configured according to one embodiment of the present disclosure.
Figure 4B:
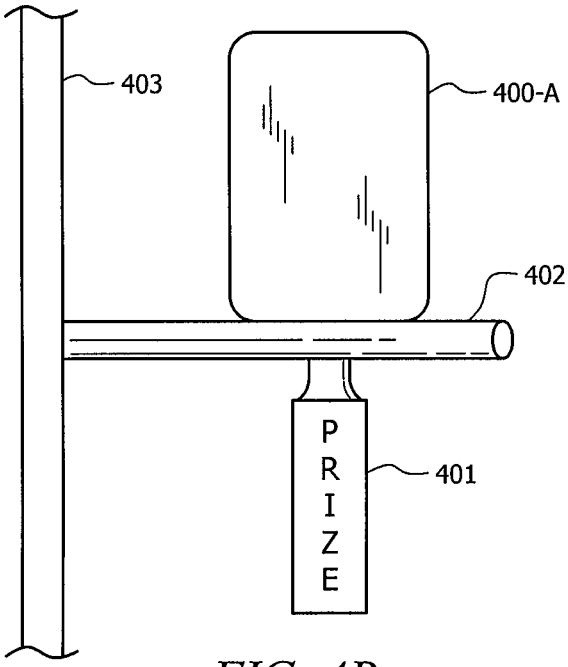
FIG. 4B is a side view of the single container—prize combination illustrated in FIG. 4A.

FIG. 4A is a front view illustrating a single pressure-filled container 400-A—prize 401 combination configured according to one embodiment of the present disclosure. Prize 401 is coupled to pressure-filled container 400-A. Container brackets 402 provide a shelf on which the pressure-filled container 400-A—prize 401 combination may be suspended within a game cabinet of a compatible redemption arcade game. FIG. 4B is a side view of the single pressure-filled container 400-A—prize 401 combination illustrated in FIG. 4A. Container bracket 402 is coupled to back wall 403 of the game cabinet, and illustrates how the pressure-filled container 400-A—prize 401 combination is suspended within the game cabinet. Container brackets 402 provide a friction-based shelf to suspend balloon 400 within the game cabinet. When the player pops pressure-filled container 400-A, container brackets 402 no longer have anything to contact, which allows prize 401 to fall to the prize chute (not shown).

Figure 4C:
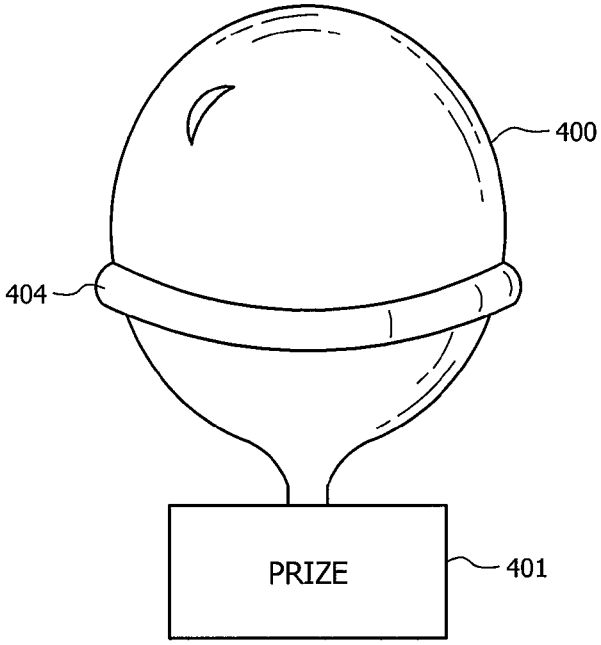
FIG. 4C is a front view illustrating a single pressure-filled container—prize combination configured according to one embodiment of the present disclosure.
Figure 4D:
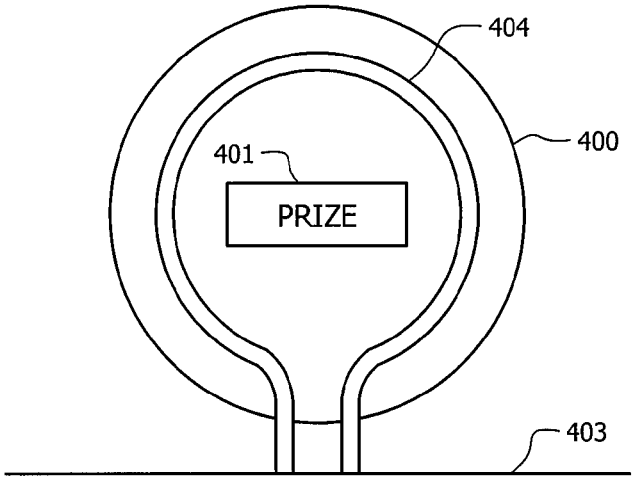
FIG. 4D is a bottom view of the single pressure-filled container—prize combination illustrated in FIG. 4C.

FIG. 4C is a front view illustrating a single balloon 400—prize 401 combination configured according to one embodiment of the present disclosure. Prize 401 is coupled to balloon 400. Container bracket 404 provides a shelf on which the balloon 400—prize 401 combination may be suspended within a game cabinet of a compatible redemption arcade game. FIG. 4D is a bottom view of the single balloon 400—prize 401 combination illustrated in FIG. 4C. Balloon bracket 404 has a circular-type shape and is coupled to back wall 403 of the game cabinet. Here again, balloon bracket 404 provide a friction-based shelf to suspend balloon 400 within the game cabinet. When the player pops balloon 400, container bracket 404 no longer has anything to contact, which allows prize 401 to fall to the prize chute (not shown).

Figure 4E:
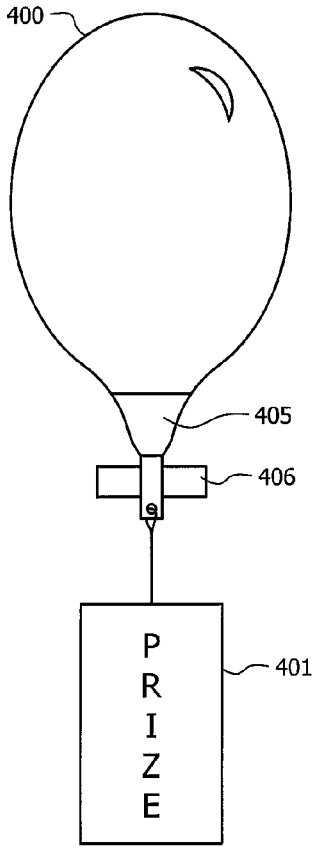
FIG. 4E is a front view illustrating a single pressure-filled container—prize combination configured according to one embodiment of the present disclosure.
Figure 4F:
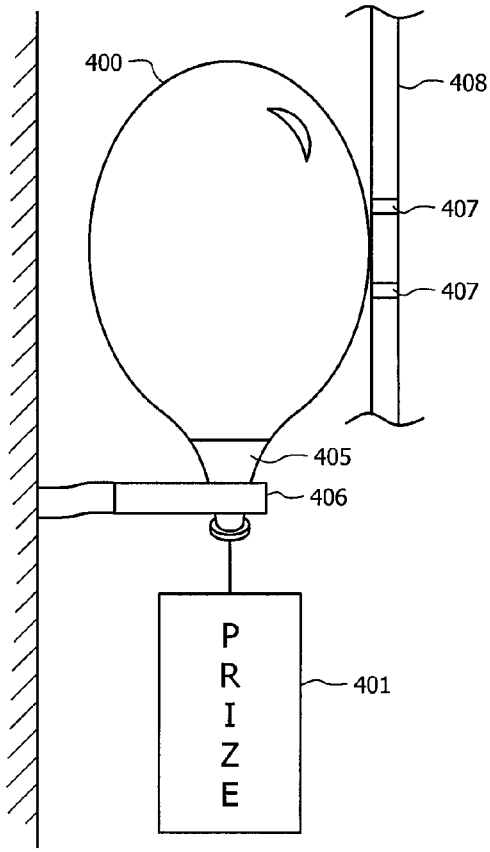
FIG. 4F is a side view of the single pressure-filled container—prize combination illustrated in FIG. 4E.

FIG. 4E is a front view illustrating a single balloon 400—prize 401 combination configured according to one embodiment of the present disclosure. Prize 401 is indirectly physically coupled to balloon 400 through container clip 405. Container bracket 406 acts as a security measure in securing the balloon 400—prize 401 combination to the game cabinet. Container bracket 406 will only release container clip 405 and prize 401 when balloon 400 is popped by the piercing mechanism of the game machine. This prevents a user from inserting a foreign object that might be able to pop balloon 400 without operating the game. FIG. 4F is a side view of the balloon 400—prize 401 combination illustrated in FIG. 4E. Sensors 407 in barrier 408 detect when the piercing mechanism of the game machine passes through the appropriate orifice. If this is detected, and 400 pops, then the game machine logic causes container bracket 406 to release container clip 408 and accompanying prize 401.

Figure 5:
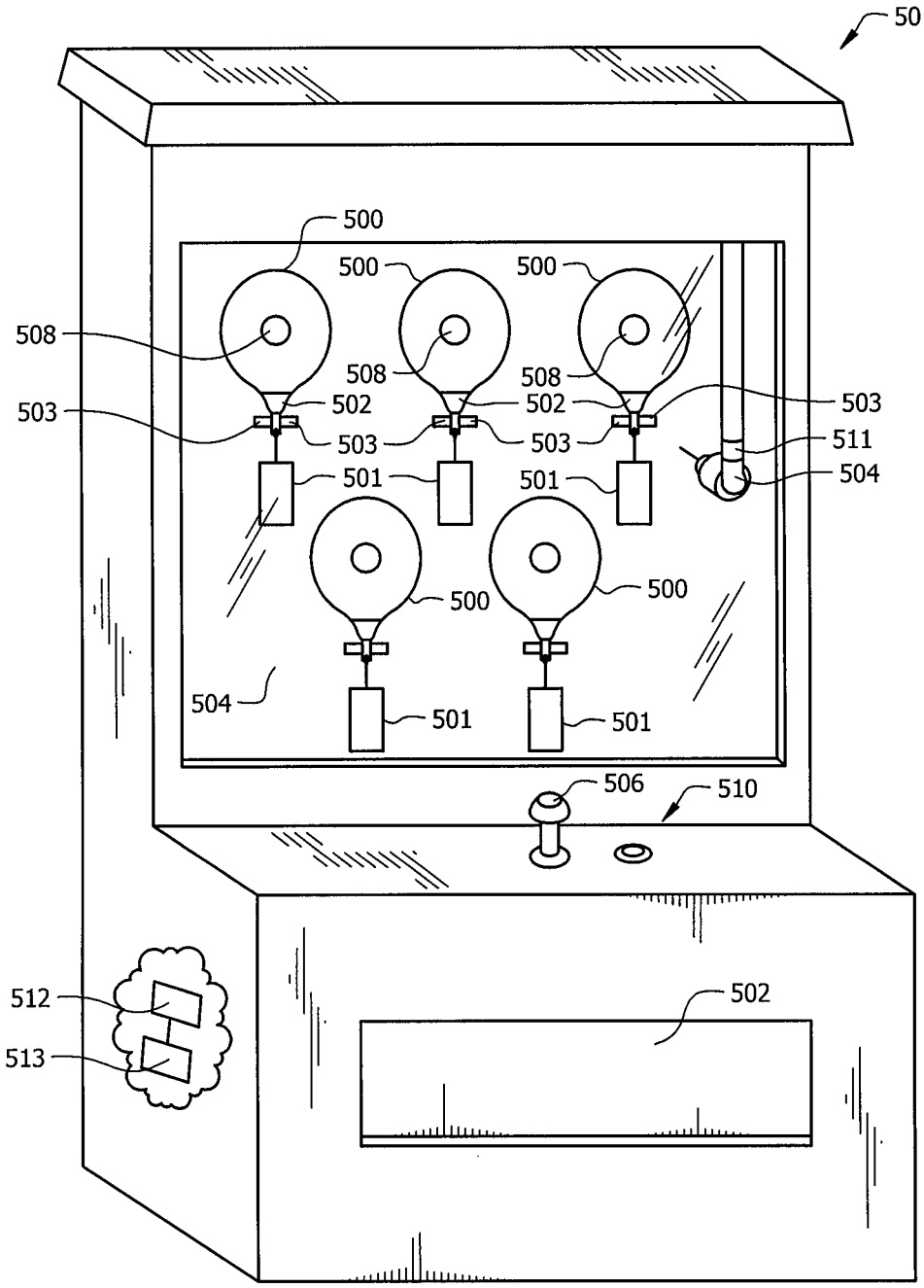
FIG. 5 is a block diagram illustrating a game machine configured according to one embodiment of the present disclosure.

FIG. 5 is a block diagram illustrating a game machine 50 configured according to one embodiment of the present disclosure. Game machine 50 contains multiple balloons 500 having prizes 501 coupled thereto through container clips 502. The balloon 500—prize 501 combinations are suspended in game machine 50 by container brackets 503. Container brackets 503 grasp onto the balloon 500—prize 501 combination at container clips 502. A user will manipulate action arm 504 using control 506 to position the piercing mechanism 505 adjacent to one of the orifices 508 in barrier 509. When the user is satisfied that he or she has properly positioned the piercing mechanism 505, he or she activates the prize attempt that causes piercing mechanism to extend toward the back of game machine 50. If the user has failed to properly align piercing mechanism 505, it will impact barrier 509 and end the user's turn. However, if the user has succeeded in properly aligning piercing mechanism with one of orifices 508, piercing mechanism will extend through orifice 508 impacting and popping the associated balloon 500 and potentially releasing prize 501 into an area accessible by the user through prize door 507.

Game machine 50 uses a security system in order to prevent a dishonest user from popping a pressure-filled container using means other than proper game play. Security systems may use sensors in barrier 509, such as sensors 407 (FIG. 4F), sensors in action arm 504, such as sensor 511, or any various combination of sensors, whether physical, such as sensors 407 and 511, or embodied in software stored in a memory, such as memory 513, or combinations of both. When processor 512 of game machine 50 operates software sensors, the software sensors track the exact distances and positions of action arm 504. The exact distance and position will let the game logic operating on processor 512 know that a valid attempt at game play has been made and cause the appropriate container bracket 503 to release the corresponding container clip 502 with prize 501. If the combination of sensor 511 and software sensors in memory 513 operating on processor 512 do not indicate that a value attempt has been made, processor 512 will not allow container bracket 513 to release balloon clip 502 regardless of whether balloon 500 attached to container clip 502 has been popped.

Figure 6:
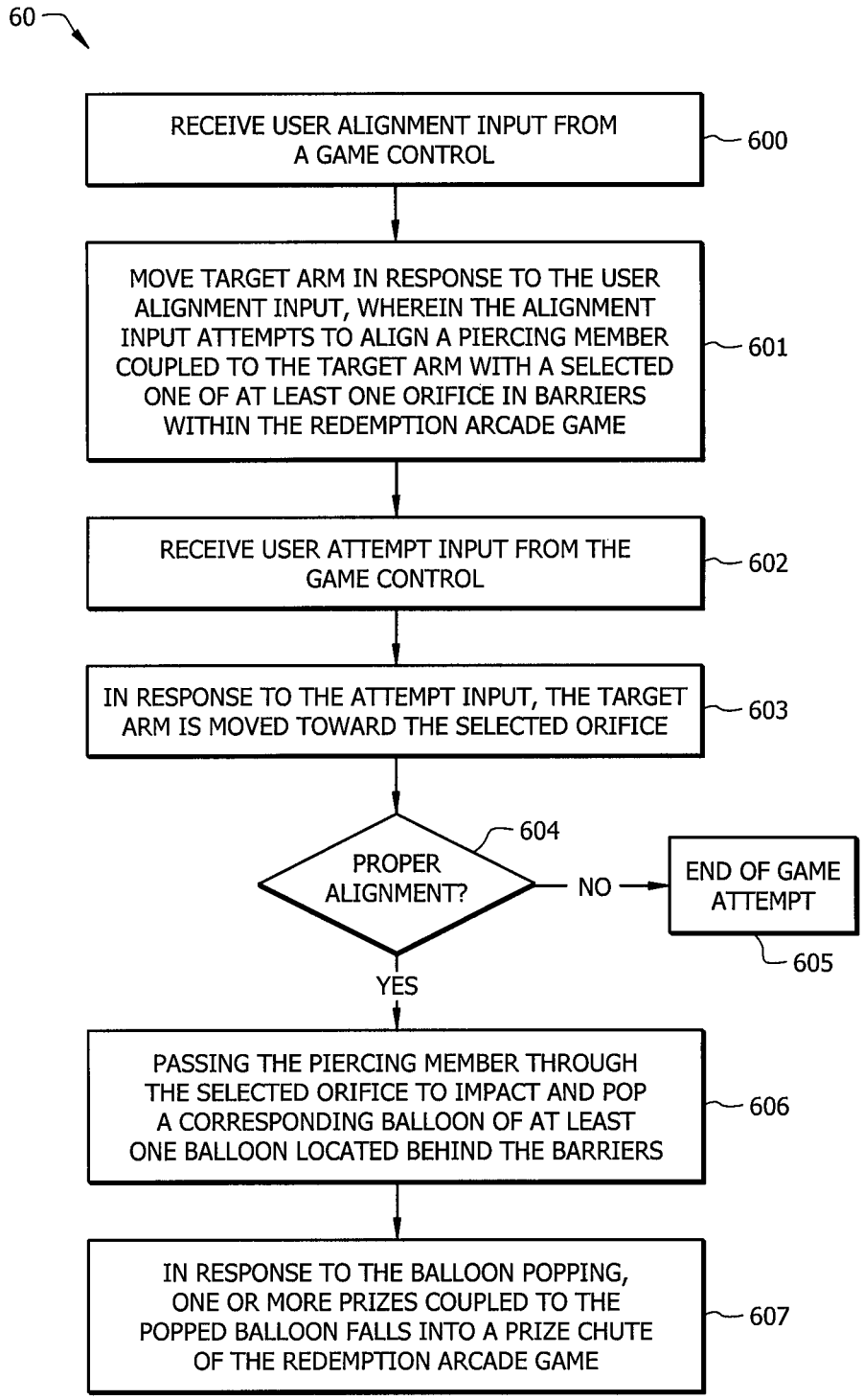
FIG. 6 is a functional block diagram illustrating example blocks executed to implement one embodiment of the present disclosure.

FIG. 6 is a functional block diagram illustrating example blocks executed to implement one embodiment of the present disclosure. In block 600, user alignment input is received from a game control. In response to the user alignment input, a target arm is moved, in block 601, wherein the alignment input attempts to align a piercing member coupled to the target arm with a selected one of many orifices in barriers within the redemption arcade game. In block 602, user attempt input is received from the game control. In response to the attempt input, the target arm is moved, in block 603, toward the selected orifice. A determination is made, in block 604, whether the piercing member has been properly aligned with the selected orifice. If not; then the piercing member impacts the barrier and the game attempt ends for the player in block 605. If the piercing member is properly aligned, then, in block 606, the piercing member passes through the selected orifice to impact and pop a corresponding pressure-filled container of a number of pressure-filled containers located behind the barriers. The redemption arcade game may be implemented having just a single pressure-filled container with a single or multiple prizes or may be implemented having multiple pressure-filled containers and attached prizes. In response to the pressure-filled container popping, in block 607, a prize or prizes coupled to the popped pressure-filled container falls into a prize chute of the redemption arcade game.

Embodiments, or portions thereof, may be embodied in program or code segments operable upon a processor-based system (e.g., computer system or computing platform) for performing functions and operations as described herein. The program or code segments making up the various embodiments may be stored in a non-transitory computer-readable medium, which may comprise any suitable medium for temporarily or permanently storing such code. Examples of the non-transitory computer-readable medium include such computer-readable media as an electronic memory circuit, a semiconductor memory device, random access memory (RAM), read only memory (ROM), erasable ROM (EROM), flash memory, a magnetic storage device (e.g., floppy diskette), optical storage device (e.g., compact disk (CD), digital versatile disk (DVD), etc.), a hard disk, and the like.

Embodiments, or portions thereof, may be embodied in a computer data signal, which may be in any suitable form for communication over a transmission medium such that it is readable for execution by a functional device (e.g., processor) for performing the operations described herein. The computer data signal may include any binary digital electronic signal that can propagate over a transmission medium such as electronic network channels, optical fibers, air, electromagnetic media, radio frequency (RF) links, and the like, and thus the data signal may be in the form of an electrical signal, optical signal, radio frequency or other wireless communication signal, etc. The code segments may, in certain embodiments, be downloaded via computer networks such as the Internet, an intranet, a local area network (LAN), a metropolitan area network (MAN), a wide area network (WAN), the public switched telephone network (PSTN), a satellite communication system, a cable transmission system, cell phone data/voice networks, and/or the like.

Figure 7:
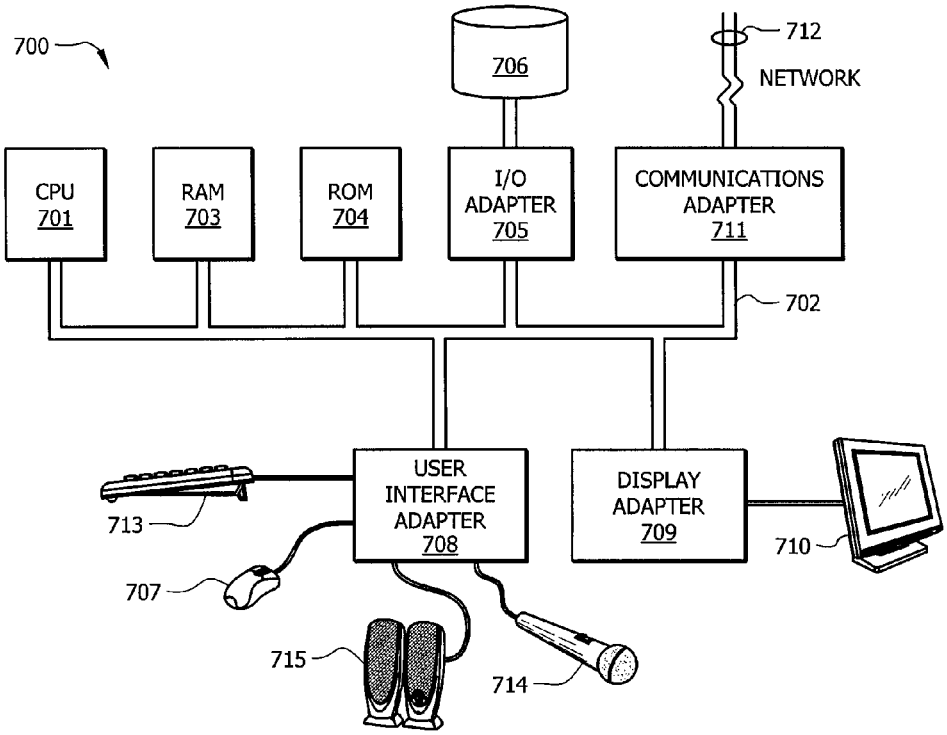
FIG. 7 illustrates an exemplary computer system which may be employed to implement the various aspects and embodiments of the present disclosure.

FIG. 7 illustrates exemplary computer system 700 which may be employed to implement the various aspects and embodiments of the present disclosure. Central processing unit ("CPU" or "processor") 701 is coupled to system bus 702. CPU 701 may be any general-purpose processor. The present disclosure is not restricted by the architecture of CPU 701 (or other components of exemplary system 700) as long as CPU 701 (and other components of system 700) supports the inventive operations as described herein. As such CPU 701 may provide processing to system 700 through one or more processors or processor cores. CPU 701 may execute the various logical instructions described herein. For example, CPU 701 may execute machine-level instructions according to the exemplary operational flow described above in conjunction with FIG. 6 and any of the other processes described with respect to illustrated embodiments. When executing instructions representative of the operational steps illustrated in FIG. 6 and any of the other processes described with respect to illustrated embodiments, CPU 701 becomes a special-purpose processor of a special purpose computing platform configured specifically to operate according to the various embodiments of the teachings described herein.

Computer system 700 also includes random access memory (RAM) 703, which may be SRAM, DRAM, SDRAM, or the like. Computer system 700 includes read-only memory (ROM) 704 which may be PROM, EPROM, EEPROM, or the like. RAM 703 and ROM 704 hold user and system data and programs, as is well known in the art.

Computer system 700 also includes input/output (I/O) adapter 705, communications adapter 711, user interface adapter 708, and display adapter 709. I/O adapter 705, user interface adapter 708, and/or communications adapter 711 may, in certain embodiments, enable a user to interact with computer system 700 in order to input information.

I/O adapter 705 connects to storage device(s) 706, such as one or more of hard drive, compact disc (CD) drive, floppy disk drive, tape drive, etc., to computer system 700. The storage devices are utilized in addition to RAM 703 for the memory requirements of the various embodiments of the present disclosure. Communications adapter 711 is adapted to couple computer system 700 to network 712, which may enable information to be input to and/or output from system 700 via such network 712 (e.g., the Internet or other wide-area network, a local-area network, a public or private switched telephony network, a wireless network, any combination of the foregoing). User interface adapter 708 couples user input devices, such as keyboard 713, pointing device 707, and microphone 714 and/or output devices, such as speaker(s) 715 to computer system 700. Display adapter 709 is driven by CPU 701 and/or by graphical processing unit (GPU) 716 to control the display on display device 710 to, for example, present the results of the simulation. GPU 716 may be any various number of processors dedicated to graphics processing and, as illustrated, may be made up of one or more individual graphical processors. GPU 716 processes the graphical instructions and transmits those instructions to display adapter 709. Display adapter 709 further transmits those instructions for transforming or manipulating the state of the various numbers of pixels used by display device 710 to visually present the desired information to a user. Such instructions include instructions for changing state from on to off, setting a particular color, intensity, duration, or the like. Each such instruction makes up the rendering instructions that control how and what is displayed on display device 710.

It shall be appreciated that the present disclosure is not limited to the architecture of system 700. For example, any suitable processor-based device or multiple such devices may be utilized for implementing the various embodiments of the present disclosure, including without limitation personal computers, laptop computers, computer workstations, multi-processor servers, and even mobile telephones. Moreover, certain embodiments may be implemented on application specific integrated circuits (ASICs) or very large scale integrated (VLSI) circuits. In fact, persons of ordinary skill in the art may utilize any number of suitable structures capable of executing logical operations according to the embodiments.

Figure 8:
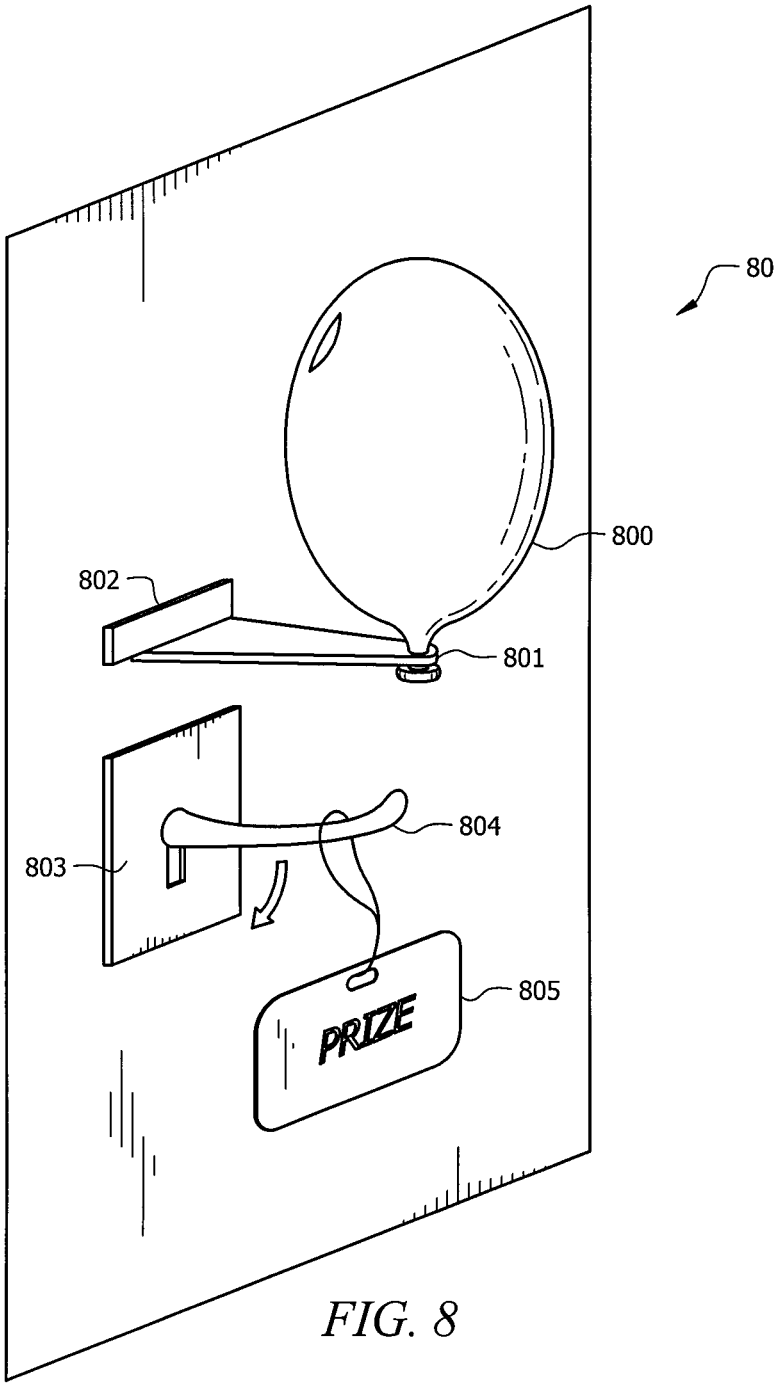
FIG. 8 is a block diagram illustrating a game machine configured according to one embodiment of the present disclosure.

FIG. 8 is a diagram illustrating a portion of a game machine 80 configured according to one embodiment of the present disclosure. As illustrated, game machine 80 includes a balloon 800 secured to a bracket 801 suspended within game machine 80. Bracket 801 is coupled to a sensor 802 which detects whether or not balloon 800 has been popped by a piercing mechanism operated by a user of game machine 80. Sensor 802 is electrically coupled to switching mechanism 803. A prize 805 is suspended on a prize arm 804 coupled to game machine 80 through switching mechanism 803. When a user successfully pops balloon 800, sensor 802 detects a valid popping and electronically signals switching mechanism 803 to lower prize arm 804 in order to drop prize 805 into the prize collection area (not shown) of game machine 80.

It should be noted that, as illustrated in the example game machine 80 configured according to one aspect of the present disclosure, prize 805 is indirectly electronically coupled to balloon 800, through bracket 801, sensor 802, and switching mechanism 803.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A gaming device comprising:

at least one pressure-filled container suspended in a game play area of said gaming device;

one or more prizes coupled to each of said at least one pressure-filled container;

one or more barriers located in front of said at least one pressure-filled container, each of said one or more barriers having at least one orifice therein providing an opening in said barrier adjacent to a corresponding one of said at least one pressure-filled container;

a target arm having a piercing member coupled thereto, said target arm moveable in at least one dimension within said game play area; and a user input interface, wherein, in response to manipulation by a user, said user input interface controls motion of said target arm allowing said user to align said piercing member with one of said at least one orifice and pass said needle through said at least one orifice to impact a corresponding target pressure-filled container of said at least one pressure-filled container.

2. The gaming device of claim 1, further comprising:

a container clip secured to each of said at least one pressure-filled container, wherein said one or more prizes is coupled to each of said at least one pressure-filled container through said container clip.

3. The gaming device of claim 2, further comprising:

a container bracket suspending said at least one pressure-filled container in said game play area, wherein said container bracket engages said container clip.

4. The gaming device of claim 3, wherein said container bracket releases said container clip when an associated pressure-filled container of said at least one pressure-filled container secured to said container clip is popped by said piercing member.

5. The game device of claim 4, further comprising:

at least one security sensor, wherein said at least one security sensor provides validity information with regard to a popped one of said at least one pressure-filled container, said validity information verifying a valid user attempt; and a security release mechanism, wherein in response to receiving said validity information verifying said valid user attempt, said security release mechanism causes said container bracket to release said container clip.

6. The game device of claim 1, further comprising:

a container bracket suspending said at least one pressure-filled container in said game play area.

7. The game device of claim 1, wherein each of said one or more prizes is coupled electronically to each of said at least one pressure-filled containers.

8. The game device of claim 7, wherein, in response to said needle impacting a corresponding target pressure-filled container, a corresponding prize of said one or more prizes is electronically signaled to be released.

9. A method of a redemption arcade game machine, comprising:

receiving user alignment input, by the redemption arcade game machine, from a game control of the redemption arcade game machine;

moving, by the redemption game machine, a target arm of the redemption arcade game machine in at least one dimension within said redemption arcade game machine in response to said user alignment input, said target arm having a piercing member coupled thereto, wherein said user alignment input attempts to align said piercing member with at least one orifice in one or more barriers within said redemption arcade game machine;

receiving, by the redemption arcade game machine, user attempt input from said game control;

in response to said user attempt input, moving, by the redemption arcade game machine, said piercing member toward said orifice, wherein when said piercing member is properly aligned with said orifice, said piercing member passes through said orifice in said one or more barriers and impacts and pops a corresponding pressure-filled container placed behind said one or more barriers, said popping of said corresponding pressure-filled container causing one or more prizes coupled to said corresponding pressure-filled container to fall into a prize chute of said redemption arcade game.

10. The method of claim 9, further comprising:

monitoring, by the redemption arcade game machine, a position of said piercing member during movement; and in response to said position indicating a valid popping of said corresponding pressure-filled container, triggering, by the redemption arcade game machine, release of said one or more prizes.

11. The method of claim 10, wherein said triggering comprises:

receiving an electronic signal transmitted in response to the monitoring, wherein the electronic signal indicates said release of said one or more prizes.

12. The method of claim 10, further comprising:

in response to said position indicating an invalid popping of said corresponding pressure-filled container, preventing, by the redemption arcade game machine, release of said one or more prizes.

13. A redemption arcade game, comprising:

means for receiving user alignment input from a game control;

means for moving a target arm in at least one dimensions within said redemption arcade game in response to said user alignment input, said target arm having a piercing member coupled thereto, wherein said user alignment input attempts to align said piercing member with at least one orifice in one or more barriers within said redemption arcade game;

means for receiving user attempt input from said game control;

means, executable in response to said user attempt input, for moving said piercing member toward said orifice, wherein when said piercing member is properly aligned with said orifice, said piercing member passes through said orifice in said one or more barriers and impacts and pops a corresponding pressure-filled container placed behind said one or more barriers, said popping of said corresponding pressure-filled container causing one or more prizes coupled to said corresponding pressure-filled container to fall into a prize chute of said redemption arcade game.

14. The redemption arcade game of claim 13, further comprising:

means for monitoring a position of said piercing member during movement; and means, executable in response to said position indicating a valid popping of said corresponding pressure-filled container, for triggering release of said one or more prizes.

15. The redemption arcade game of claim 14, wherein said means for triggering comprises:

means for receiving an electronic signal transmitted in response to the means for monitoring, wherein the electronic signal indicates said release of said one or more prizes.

16. The redemption arcade game of claim 14, further comprising:

means, executable in response to said position indicating an invalid popping of said corresponding pressure-filled container, for preventing release of said one or more prizes.

17. A computer program product for a redemption arcade game, comprising:

a non-transient computer-readable medium having program code recorded thereon, the program code comprising:

program code to receive user alignment input from a game control;

program code to move a target arm in at least one dimensions within said redemption arcade game in response to said user alignment input, said target arm having a piercing member coupled thereto, wherein said user alignment input attempts to align said piercing member with a least one orifice in one or more barriers within said redemption arcade game;

program code to receive user attempt input from said game control;

program code, executable in response to said user attempt input, to move said piercing member toward said orifice, wherein when said piercing member is properly aligned with said orifice, said piercing member passes through said orifice in said one or more barriers and impacts and pops a corresponding pressure-filled container placed behind said one or more barriers, said popping of said corresponding pressure-filled container causing one or more prizes coupled to said corresponding pressure-filled container to fall into a prize chute of said redemption arcade game.

18. The computer program product of claim 17, further comprising:

program code to monitor a position of said piercing member during movement; and program code, executable in response to said position indicating a valid popping of said corresponding pressure-filled container, to trigger release of said one or more prizes.

19. The computer program product of claim 18, wherein said program code to trigger comprises:

program code to receive an electronic signal transmitted in response to the program code to monitor, wherein the electronic signal indicates said release of said one or more prizes.

20. The computer program product of claim 18, further comprising:

program code, executable in response to said position indicating an invalid popping of said corresponding pressure-filled container, to prevent release of said one or more prizes.

* * * * *

UNITED STATES PATENT AND TRADEMARK OFFICE

CERTIFICATE OF CORRECTION

PATENT NO. : 8,714,555 B1
APPLICATION NO. : 13/667283
DATED : May 6, 2014
INVENTOR(S) : Jeremy Kelsey et al.

It is certified that error appears in the above-identified patent and that said Letters Patent is hereby corrected as shown below:

In the Specification:

At column 8, line number 7, delete "If not;" and replace with --If not,--.

In the Claims:

At column 11, claim number 9, line number 27, delete "redemption game" and replace with --redemption arcade game--.

Signed and Sealed this
Fifth Day of August, 2014

Michelle K. Lee

Michelle K. Lee
*Deputy Director of the United States Patent and Trademark Office*